US006917308B2

(12) United States Patent
Hilliard

(10) Patent No.: US 6,917,308 B2
(45) Date of Patent: Jul. 12, 2005

(54) SURFACE-MOUNT TRAFFIC SENSORS

(75) Inventor: Steven R. Hilliard, Knoxville, TN (US)

(73) Assignee: Inductive Signature Technologies, Inc., Knoxville, TN (US)

( * ) Notice: Subject to any disclaimer, the term of this patent is extended or adjusted under 35 U.S.C. 154(b) by 127 days.

(21) Appl. No.: 10/425,485

(22) Filed: Apr. 29, 2003

(65) Prior Publication Data

US 2003/0201909 A1 Oct. 30, 2003

Related U.S. Application Data

(60) Provisional application No. 60/376,389, filed on Apr. 29, 2002.

(51) Int. Cl.[7] ..... G08G 1/02

(52) U.S. Cl. ..... 340/940; 340/933; 73/152.51; 73/152.53; 200/86 A

(58) Field of Search ..... 340/940, 933, 340/907, 626, 666; 73/152.51, 37, 152.53; 200/86 A, 211

(56) References Cited

U.S. PATENT DOCUMENTS 4,862,163 A 8/1989 Sobut
4,941,770 A 7/1990 Gemmer
4,945,356 A 7/1990 Henderson et al.
5,245,334 A 9/1993 Gebert et al.
5,331,276 A 7/1994 Polvani et al.
5,450,077 A * 9/1995 Tyburski ..... 340/933
5,477,217 A * 12/1995 Bergan ..... 340/933
5,554,907 A 9/1996 Dixon
5,646,615 A * 7/1997 Moore ..... 340/940
6,342,845 B1 1/2002 Hilliard et al.

* cited by examiner

*Primary Examiner*—Toan N. Pham
(74) *Attorney, Agent, or Firm*—Pitts & Brittian, P.C.

(57) ABSTRACT

Surface-mounted traffic monitoring sensors that do not require substantial disruption to traffic flow to install or maintain, and that do not substantially degrade the physical integrity of the road. Pneumatic road-tube wedges and surface-mount inductive blades detect wheel-spikes and/or inductive signatures in both fixed and portable installations, single or multi-lane roadways, and provides accurate vehicle speed, volume, occupancy, turning movement counts, weaving sections, classification, re-identification, travel-time, origin and destination, lane-keeping variation, speed-variation, angle-of-attack, and vehicle weight and load distribution. This data is useful to infrastructure planners, traffic-flow modelers, to enhance the safety of work-zone crews, law enforcement, and for real-time traffic operations, etc.

4 Claims, 6 Drawing Sheets

SURFACE-MOUNT TRAFFIC SENSORS

CROSS-REFERENCE TO RELATED APPLICATIONS

This application claims the benefit of U.S. Provisional Application No. 60/376,389, filed Apr. 29, 2002.

STATEMENT REGARDING FEDERALLY SPONSORED RESEARCH OR DEVELOPMENT

Not Applicable.

BACKGROUND OF THE INVENTION

1. Field of the Invention

The present invention generally relates to vehicle detection. More particularly, this invention pertains to portable or temporary sensors and related deployment and analysis methods used for the detection, classification, or re-identification of automotive vehicles.

2. Description of the Related Art

Collection of real-time traffic data is useful for work-zone safety, Advanced Traveler Information Systems (ATIS), Advanced Transportation Management Systems (ATMS), traffic law-enforcement, and for collision avoidance among many other things.

Collection of historical traffic-flow data is essential for making well informed infrastructure planning decisions, and for validating and calibrating sophisticated traffic flow and econometric models. Prior-art methods for collecting wide area historical traffic-flow data have not provided as much data as is needed on a cost effective basis, and they can require significant disruption of traffic flow while sometimes exposing staff to unnecessary risk. The limitations of prior-art data collection methods have spurred the development of products that use roadside-deployable technologies to detect traffic. The most successful of these prior-art technologies are side-fire RADAR, and Video Image Processing Systems (VIPS); however, RADAR systems are limited in their ability to monitor multi-lane traffic and they are not adequate for precision vehicle re-identification. VIPS include License Plate Recognition (LPR) systems as well as vehicle shape/color recognition systems. VIPS systems perform reasonably well (~98% accuracy) when the lighting and weather conditions are favorable, but are privacy-intrusive, are not reliable for round-the-clock operations, suffer from occlusion, and are difficult to calibrate in place without a reference detection system.

Comprehensive information on the use of transportation facilities provides the basis for many of the decisions made regarding the transportation infrastructure. Generally, the traffic data needed to support the decision-making process and the design process includes traffic volume (vehicle counts), vehicle classification (typically by axle count), average speeds, and lane occupancy. Travel-time and origin/destination (O/D) data is particularly useful to planners, but it has been notoriously difficult, expensive, and privacy-intrusive to the public to collect this data in the past. The availability and reliability of the traffic data collected for use by planners is important because it affects funding priorities and the design of highway projects. Yet, until the last decade, the methods for collecting historical traffic data over a wide area were essentially limited to a mixture of fixed counting locations using common inductive loop detectors, common road tube counts, and human observation. Each of these methods has limitations that have historically made traffic data collection a significant challenge, especially in urban areas.

Fixed counting locations with common inductive loop detectors can provide a baseline for traffic data collection. Common road tubes are widely used for temporary sampling of traffic volumes, but they can present problems for staff safety, traffic disruption, and poor data collection performance. Staff safety is a concern when common road tubes must be set where traffic volumes are high during peak periods and relatively high during off-peak periods. Disruption of traffic flow typically occurs when setting common road tubes on moderate or high-volume roadways because temporary closure of traffic lanes may be needed to provide safety for personnel. Performance of common road tube counters is often hampered by complex roadway geometrics, multiple lane roadways, and adverse weather conditions.

Manual counts present safety and operational problems. Manual counts can place staff at risk if they must be exposed to vehicular traffic for long periods during counts. Another safety problem results from personnel being located in areas where crime presents a threat to personal safety. Extreme weather conditions further limit the implementation of a conventional manual count. Also, in some cases, the presence of counting staff can affect the traffic flow on very high-volume roadways.

These problems have resulted in a number of new technologies being employed in devices for collecting traffic data in urban areas. These technologies are considered to be non-intrusive because they can be deployed without the need to close lanes to traffic or to expose staff to unsafe conditions. Even though traffic detection devices using these non-intrusive technologies have been available for several years, there are still many uncertainties regarding their appropriate application and performance.

The following factors must be considered when evaluating non-intrusive devices: Level of expertise required and time spent installing and calibrating a device; Reliability of a device; Number of lanes a device can detect; Mounting options such as overhead, side-fire and height; Ease of installation and moving from one location to another; Capability for remote adjustment of calibration parameters and trouble shooting; Wireless communication to simplify the data retrieval process; Solar powered or battery powered devices for temporary counts in locations without an accessible source of power; Type of traffic data provided; Performance in various weather and traffic conditions; and the intended use for a particular device, (e.g., a device used to actuate a signal must meet a different set of performance criteria than a device used to collect historical traffic data). Some devices are also designed to offer real time information for ITS applications.

Many of these non-intrusive devices are well suited for temporary counting situations. Ease of installation and flexibility in mounting locations and power supplies are important elements in selecting a portable device that can be installed quickly and moved from location to location. The devices that use Doppler microwave, active infrared, and passive infrared technologies have a simple "point-and-shoot" type of setup. Passive magnetic, radar, passive acoustic and pulse ultrasonic devices require some type of adjustment once the device is mounted. In most cases this adjustment must be performed over a serial communication line. Video devices require extensive calibration over serial communication lines and are not well suited for temporary counting. Extensive installation work is required for video and passive magnetic devices, making them less suitable for temporary data collection. From an overhead mounting location at the freeway test site, the video and passive acoustic devices have been found to count within four to ten percent of baseline volume data. Pulse ultrasonic, Doppler microwave, radar, passive magnetic, passive infrared, and active infrared have been found to count within three percent of baseline volume data. The count results are more varied at intersection test sites. The pulse ultrasonic, passive acoustic, and video devices are generally within ten percent of baseline volume data while some passive infrared devices can perform within five percent. Speed data can be collected from active infrared, passive magnetic, radar, Doppler microwave, passive acoustic, and video devices. In general, all of these devices can measure speed within eight percent of baseline. Radar, Doppler microwave, and video are the most accurate prior-art technologies at measuring vehicle speeds. Video and radar devices have the advantage of multiple-lane detection from a single unit. Video has the additional advantage of providing a view of the traffic operations. Weather variables have been found to have minimal direct affect on device performance, but snow on the roadway can cause some vehicles to track outside of their normal driving patterns, affecting devices with narrow detection zones. Lighting conditions have been observed to affect some of the video devices, particularly in the transition from day to night. Extremely cold weather can make access to such devices difficult, especially for the magnetic probes installed under the pavement. Urban traffic conditions, including heavy congestion, have been found to have little effect on the performance of these devices. In general, the differences in performance from one device to another within the same technology have been found to be more significant than the differences from one technology to another. Among the various technologies of the prior-art, it may be more important to select a well designed and highly reliable product than to narrow a selection to a particular technology.

Available prior-art devices are known to incorporate multiple technologies within a single device. Developments in other technologies, such as passive millimeter microwave and infrared video, are expected to produce additional entries into the market.

Conventional wheel-spike detectors of the prior art are typically implemented as axle detectors using pneumatic tubes, but are occasionally implemented using piezoelectric strips, filter optic treadle, or narrow-aperture inductive loops. Pneumatic tubes are widely used for temporary traffic counts, and have demonstrated a modest capability for vehicle classification.

BRIEF SUMMARY OF THE INVENTION

It is desirable to deploy pavement sensors (including temperature, salinity, and weigh-in-motion sensors) and vehicle sensors in both permanent and temporary installations without substantial disruption to traffic flow, and without degrading the physical integrity of the pavement. The present invention describes various non-intrusive sensor apparatus and methods for fabricating and deploying them which accomplish the following objects of the invention, as well as many others.

It is a first object of the present invention to more accurately count, classify, re-identify, and measure the speed, occupancy, lane position, and angle-of-attack of vehicles passing by a fixed point on a roadway having one or more lanes.

It is a second object of the present invention to accurately re-identify vehicles passing by a plurality of fixed points on a roadway to directly measure travel-time, origin and destination, detect incidents, and to monitor behavioral characteristics of individual drivers including lane-keeping, speed variation, and car following behaviors.

It is a third object of the present invention to instrument multi-lane roadways more cost effectively on either a permanent or temporary basis.

It is a fourth object of the present invention to achieve the aforementioned objects of the invention with a portable detection system that is relatively safe, fast, and easy to install and uninstall with a minimum of disruption to traffic flow.

It is a fifth object of the present invention to improve work-zone safety by monitoring traffic-flow upstream of a work-zone using the portable traffic-flow monitoring capability of the present invention to provide timely warnings and accurate characterizations of unsafe conditions.

It is a sixth object of the present invention to provide a surface-mount blade sensor suitable for rapid deployment on the surface of a roadway without cutting into the pavement.

It is a seventh object of the present invention to provide a sensor geometry for a blade sensor that will maximize the useful information gleaned from detected vehicles.

It is an eighth object of the present invention to detect laterally asymmetrical features of a vehicle for increased vehicle classification and re-identification precision.

It is a ninth object of the present invention to provide a method for prefabricating a surface-mount sensor.

It is a tenth object of the present invention to provide a method for the safe, efficient, precise, and non-intrusive deployment of surface-mount blade sensors.

It is an eleventh object of the present invention to provide a road-tube wedge sensor suitable for rapid deployment of the surface of a roadway.

It is a twelfth object of the present invention to provide a sensor geometry for a road-tube sensor that will maximize the useful information gleaned from detected vehicles.

It is an thirteenth object of the present invention to restrict the inside-diameter of a road-tube sensor in order to damp unwanted oscillations of a gas contained within the road-tube.

It is a fourteenth object of the present invention to reduce the tendency of a road-tube sensor to roll in response to coming in contact with the wheels of over-passing vehicles.

It is a fifteenth object of the present invention to sense pressure changes at both ends of a road-tube to measure the lateral position of each wheel of an over-passing vehicle.

It is a sixteenth object of the present invention to sense pressure changes at both ends of a road-tube to cancel common-mode noise.

It is a seventeenth object of the present invention to detect the direction of travel for a vehicle based on the pressure changes sensed at one or both ends of a single road-tube.

It is an eighteenth object of the present invention to provide a method for the safe, efficient, precise, and non-intrusive deployment of road-tube wedge.

It is a nineteenth object of the present invention to provide a method for deploying vehicle sensors below the pavement surface using pre-existing expansion-joints to house sensing elements and lead-lines.

It is a twentieth object of the present invention to provide an expansion-joint geometry for the construction of new pavement which facilitates the deployment of vehicle sensors below the pavement surface using the expansion-joints to house sensing elements and lead-lines.

It is a twenty-first object of the present invention to provide an expansion-joint geometry for the construction of new pavement which optimizes the useful information obtained from vehicle sensors deployed below the pavement surface that use the expansion-joints to house sensing elements and lead-lines.

It is a twenty-second object of the present invention to provide signal processing methods for extracting the maximum amount of useful information from the various sensors of the present invention.

It is a twenty-third object of the present invention to characterize the impedance to traffic flow in real time by monitoring traffic flow downstream from a work-zone.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
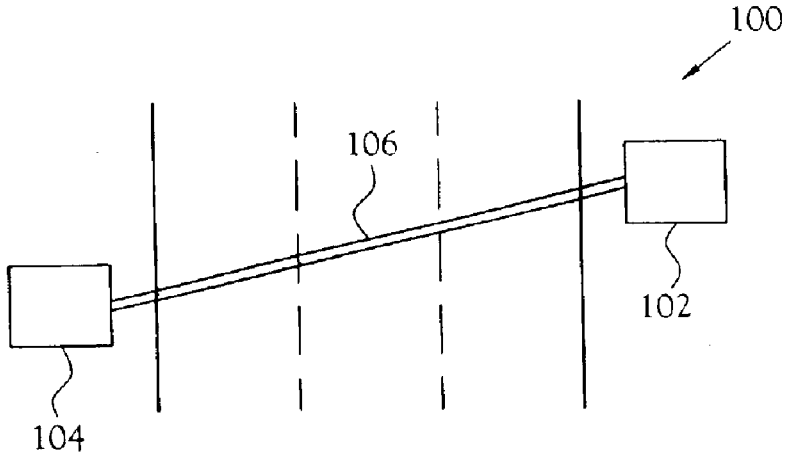
FIG. 1 depicts a surface-mount tube sensor of the present invention.

Portable sensors for monitoring traffic data is shown generally in the figures and described herein. The portable sensors are adapted for ease of installation, portability, and reusablility. One embodiment of the present invention utilizes road-tube pressure sensors and another embodiment is based on inductive sensors.

By obtaining more accurate vehicle data, historical, real-time and predictive traffic flow can be observed. This leads to more efficient use of current roadways, better planning for future roadway expansion, incident detection, and overall safer more cost effective roadway management. By re-identifying vehicles on the roadway passing a plurality of fixed points, a wealth of new traffic data can be obtained. As vehicles pass between two fixed sensor points on the roadway, the travel time of each vehicle between the two points can be calculated providing real-time point-to-point travel time measurement. The vehicle data from these two points provide "sectional" information for the leg of roadway between the two points. If many sensor-instrumented legs are connected to provide uninterrupted sectional sensor coverage, vehicles may be tracked point-to-point and section-by-section. By observing vehicle paths across the entire instrumented system, origin/destination data is produced by the system. Vehicle origin/destination data along with the sectional roadway information make it possible to do predictive traffic flow modeling. Also, because the system is providing real-time data, the system can be used to quickly detect and respond to traffic incidents. The system can also be used to monitor driver behavioral characteristics as the vehicle changes lanes, speed, and following distance, giving notice of erratic behavior. By installing a single sensor that covers all lanes of traffic, the sensor provides a lower cost solution than the installation of a sensor for each lane needing coverage.

A system that can be installed quickly without traffic flow disruption translates to safer conditions for both the traffic workers and vehicle occupants. By making the system portable, it can be deployed quickly in almost any roadway environment. By installing a portable traffic flow monitor upstream from a work zone, construction workers can have early detection of possible unsafe conditions on or near the roadway work zone. Vehicles driving at high speed or displaying erratic behavior can be identified by the system to warn workers of potential hazards. By also installing a traffic flow monitor downstream, traffic flow impedance due to work zone operations can be measured in real time.

Providing a sensor that can be installed rapidly, without cutting into the roadway, overcomes many problems that other vehicle detection technologies face, especially common inductive loop technologies. Cutting the roadway surface to install vehicle sensors takes a longer period of time which causes traffic to be stopped for installation. This exposes workers to dangerous work environments, causes traffic delays, and makes sensor installation more expensive. Cutting the roadway surface generally leads to faster roadway deterioration. By rapidly installing the sensor onto the roadway surface, the surface is not harmed, traffic workers are safer, and traffic delays are minimized. By varying the sensor geometry, different unique vehicle characteristics can be gleaned from the inductive signature of that vehicle. Generally, as the area of the inductive loop sensor increases, the characteristics of the inductive signature of the vehicle become less distinct. As the area of the inductive loop sensor decreases, some vehicle features become more prominent in the inductive signature when compared to other vehicle features. A rectangular loop sensor that is wider than the vehicle but has a narrow length may detect certain vehicle features, such as wheel spikes. A square loop sensor with a width near that of the vehicle, causing it to have a much larger area, will detect less individual vehicle features as the sensor will produce a more smoothed inductive signature because the sensor is detecting more vehicle features at once. However, at larger area loop sensor does provide a better overall picture of the vehicle (e.g., stronger signal). The sensor loop geometry must take this into account and produce a balance between feature detail and overall vehicle sensor response.

Traditional road tube sensors are primarily used for counting road vehicles. The present invention embodies a new approach to utilizing tube sensors to glean more information about the vehicles. With the new geometries, properties like vehicle wheel base, speed, angle-of-attack, and lane position can be determined. One impediment to obtaining a vehicle signature from tube pressure changes is oscillations in the signal caused by the elasticity of the tube and the gas. It is desired to dampen the oscillations so that the features of interest, like wheel spikes, are not obscured. One solution is to restrict the inside-diameter of the tube. Small inside diameter tubes, such as ½-inch or smaller, offer improved dampening which eliminates or reduces the impulse response when a tire hits the tube. One inside diameter which has been found to provide a good signal response is approximately ⅜-inch. Alternatively, a filler can be inserted into the tube to occupy some of the volume. Other variables that can affect the response of the signal are tube wall thickness, tube wall construction, and the type of gas in the tube. Typically, a road tube sensor uses a single pressure sensor at one end of the tube with the other end sealed-off.

FIG. 1 illustrates one embodiment of a portable traffic sensor 100 using a pressure sensor 102, 104 at each end of the tube 106. This arrangement takes advantage of the fact that when a vehicle runs over the tube 106, the propagation of the pressure change in the tube 106 has a fixed speed. Using this arrangement, the lateral position of the car in the lane is found by measuring the time differential in the signal generated between the two sensors 102, 104. A second advantage of using two pressure sensors 102, 104 is that common-mode noise on the sensors is canceled out by subtracting the signals from the two sensors 102, 104. One form of common-mode noise is temperature drift in the pressure sensors 102, 104. If the temperature drift is fast enough, it can be difficult to separate the drift from the desired signal, especially when the signal is relatively small.

The data from the two pressure sensors 102, 104 are synchronized so that the data recorded by each pressure sensor 102, 104 that corresponds to a single event can be matched up. One method of synchronization is to time stamp the data using a reference clock, such as an atomic clock. Another method is to apply a common trigger to start both pressure sensors. Yet another option is to match the event data during post-processing.

Figure 2:
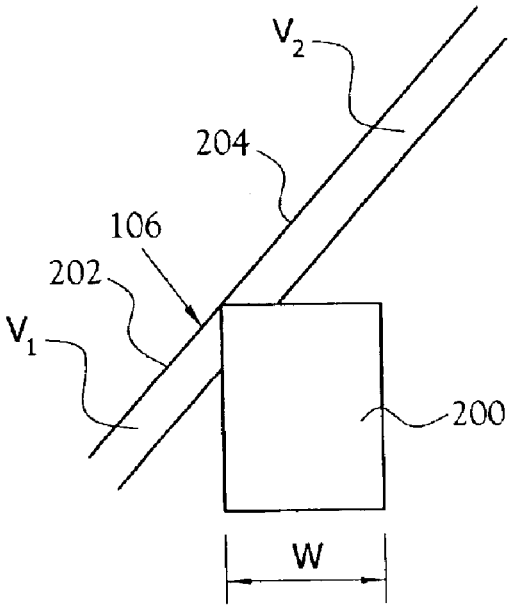
FIG. 2 illustrates a road tube sensor at a skew angle and a tire first engaging the sensor.
Figure 3:
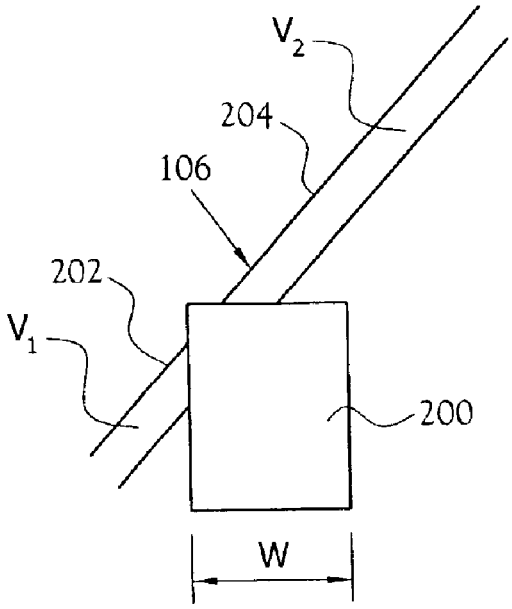
FIG. 3 illustrates the road tube sensor of FIG. 2 where the tire has moved to a second position relative to the sensor.

Due to the nature of a vehicle tire 200 (wheel, track, etc.) striking a skewed tube sensor 100, vehicle direction can be determined, as illustrated in FIG. 2 and FIG. 3. Because the tire 200 has a width W and the tube 106 is at an angle to the tire 200, the tire 200 is going to strike a small segment of the tube 106 initially, shown in FIG. 2. This pinches the tube 106, essentially sealing off the tube 106 and dividing it into two gas filled regions 202, 204. As the tire 200 continues to roll over the tube 106, illustrated in FIG. 3, the volume $V_2$ of one region 204 gets smaller while the volume $V_1$ of the other region 202 stays the same. This causes the pressure in the first region 204 to continue to increase. This effect can be detected with one or both ends of the tube 106 connected to pressure sensors 102, 104.

Figure 4:
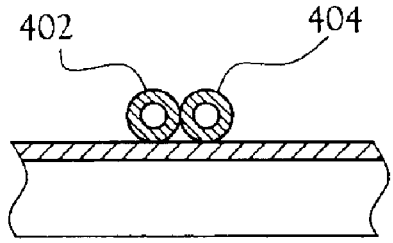
FIG. 4 illustrates one embodiment of the surface-mount tube sensor adapted to prevent rolling using two connected tubes.
Figure 5:
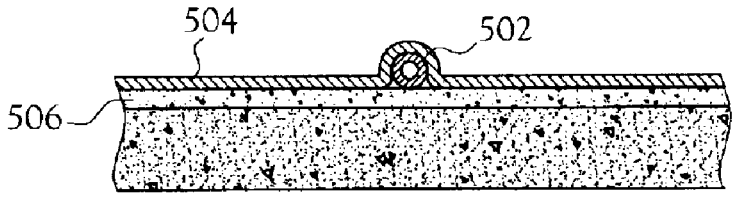
FIG. 5 illustrates another embodiment of the surface-mount tube sensor adapted to prevent rolling using an adhesive covering.

It is better when road-tubes are prevented from rolling on the roadway when a vehicle travels over them. In one embodiment, two tubes are attached together side-by-side to help eliminate the roll effect, as illustrated in FIG. 4. Various methods of attaching the tubes 402, 404 can be used. In the illustrated embodiment the tubes 402, 404 are adhered together along the length of the tubes 402, 404 using an epoxy or other adhesive. In an alternate embodiment, the tubes are secured together in a mechanical fashion; such as with bands or straps. In an alternate embodiment, the tube 502, illustrated in FIG. 5, is placed on an adhesive surface 504 and the adhesive surface 504 is secured to the road surface 506 to prevent the tube 502 from rolling.

Figure 6:
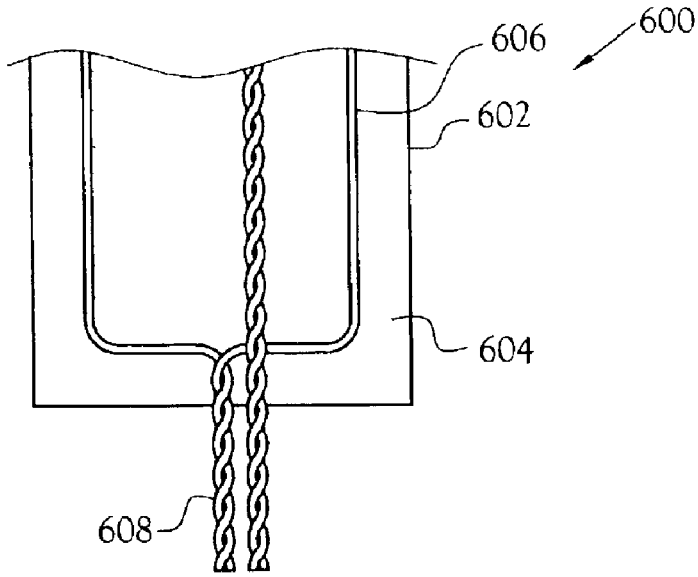
FIG. 6 illustrates a surface-mount inductive sensor of the present invention.

Surface-mount inductive sensors require a different approach. To aid in fast installation of temporary and permanent surface-mount traffic sensors it is preferred to prefabricate the sensors in a proper configuration. One embodiment of a surface-mount inductive sensor 600 is illustrated in FIG. 6. A film 602, such as bituthane tape, is laid down with the adhesive side 604 up. Those skilled in the art will recognize that other films and materials can be used without departing from the scope and spirit of the present invention, including non-adhesive films to which a separate adhesive is applied. The film 602 is adapted for resistance to wear caused by the passage of vehicles over the film 602. A suitable conductive wire 606 is pressed into the adhesive side to form a loop of the desired dimensions. In one embodiment, a #22 nylon coated copper wire is used as the suitable conductive wire 606. Those skilled in the art will recognize that other types and sizes of wire can be used without departing from the scope and spirit of the present invention. With a single turn of the #22 nylon coated copper wire that is attached to the adhesive side of a 4-inch wide piece of bituthane tape a surface-mount blade is formed. A 3-inch long by 13-foot wide rectangle is defined by the wire 606 and is suitable for detecting automobiles, where the longer dimension W is chosen to span the entire width of the traffic lane, and the smaller dimension L is chosen to detect the inductive signature and wheel-spikes. It is sometimes desirable to extend the width of the sensors into the shoulders of the road; this reduces some edge boundary effects that occur when vehicles approach the edge of a sensor.

Figure 19:
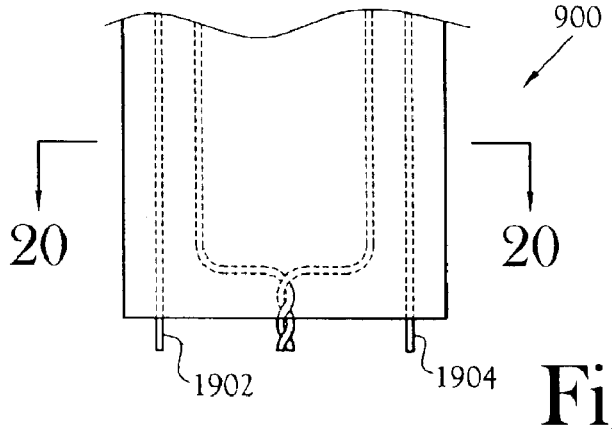
FIG. 19 illustrates a surface-mount inductive sensor including a protective covering over the adhesive and quick-release tabs.
Figure 20:
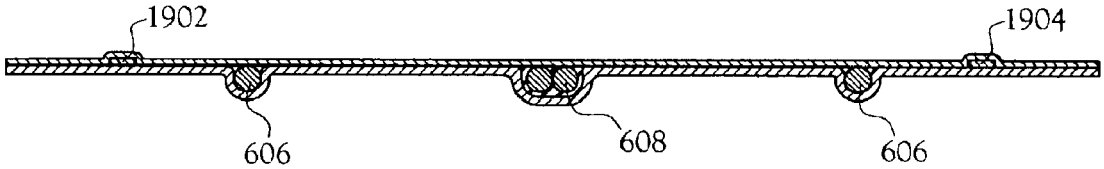
FIG. 20 illustrates a cross-section of the surface-mount inductive sensor of FIG. 19 taken at 20—20.

FIG. 19 illustrates an alternate embodiment of the surface-mount sensor 900 of FIG. 6. The surface-mount sensor includes a pair of tabs 1902, 1904 positioned to assist in the removal of a protective sheet covering the adhesive surface. FIG. 20 illustrates a cross-section of the assembled surface-mount sensor 900 complete with tabs 1902, 1904 and the protective sheet 2002. Those skilled in the art will recognize that a string or other separator can be used to aid in removing the protective sheet.

Figure 7:
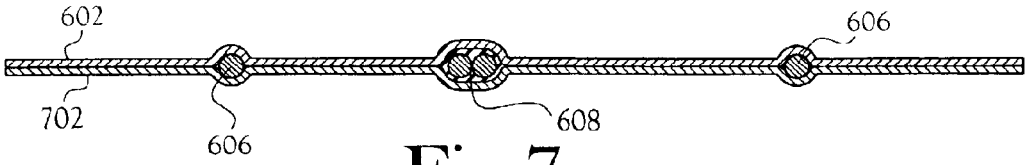
FIG. 7 illustrates another embodiment of the surface-mounted inductive sensor with improved wear resistance.

In one embodiment, a loop is formed in the adhesive surface 604 for each traffic lane that needs to be covered. When covering multiple lanes, lead lines 608 of loops covering outer lanes may be twisted and run down the center of the film 602 illustrated in FIG. 6. An epoxy or other adhesive is applied to the lead line pairs in order to keep the individual wires of the pair from moving with respect to one another when a vehicle traveling in one of the inner lanes rolls over them. Failure to prevent such relative movement of lead-line wires introduces the detection of unwanted, or false, signals. In an alternate embodiment, illustrated in FIG. 7, a second layer of bituthane tape 702 is used to cover the wires 606, 608 embedded into the first layer 602 to form a wire-loop "sandwich." The second film layer 702 offers additional protection to the wires by preventing direct concrete\asphalt to wire contact. This increases the life expectancy of the surface-mount sensor.

Figure 8:
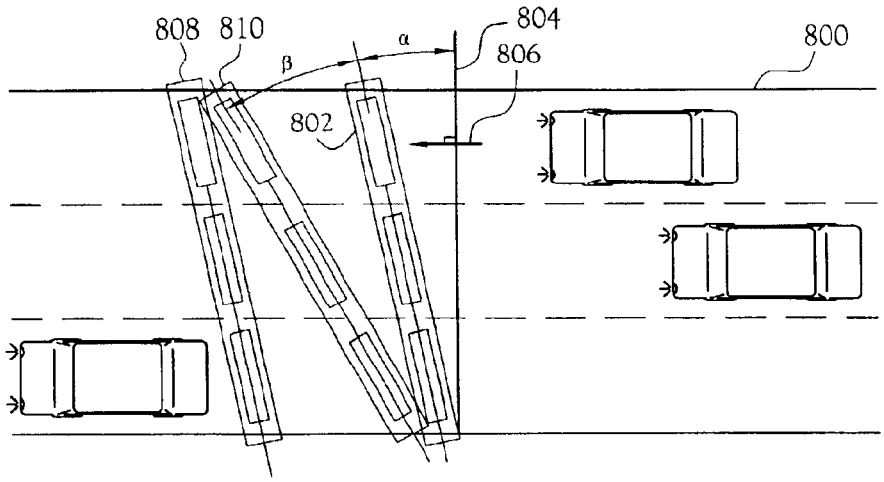
FIG. 8 depicts three surface-mount inductive sensors of the present invention deployed in a traffic lane to detect presence, occupancy, speed, acceleration, lateral offset, angle of attack, wheel-base dimensions, lateral asymmetry of features, as well as the characteristic inductive signature.

The surface-mount sensors of the present invention provide better data when they are placed on the roadway in a controlled manner. Layout of each sensor is a key to maximizing the performance of these sensors, as illustrated in FIG. 8. Anchor points may be set, or simply marked, on each side of the roadway 800 to ensure proper angles $\alpha$, $\beta$ of each sensor 802, 808, 810 in relation to oncoming traffic. A measuring tape and right-angle square or surveying equipment are used to position the anchor points. These anchor points are placed on the side of the roadway so that, when the surface-mount sensor is stretched between any two anchor points, the sensor 802 forms approximately a 20° angle $\alpha$ with a line perpendicular 804 to the direction of traffic flow 806, as shown in FIG. 6. Those skilled in the art will recognize that the angle $\alpha$ may vary considerably from 20° and still remain within the scope and spirit of the present invention. However, the chosen angle $\alpha$ needs to be used consistently within any given monitoring system. A single sensor 808 per-lane is used to collect traffic data. A second sensor per-lane can be added parallel to and slightly downstream from the first sensor to form a speed-trap. A third sensor 810 is added at an angle $\beta$ relative to the first sensor 802, such as −20° or another substantially opposite angle to increase the identifying information (e.g., lateral asymmetry measurement) collected for each detected vehicle.

Because certain vehicle features, such as the exhaust system, are often asymmetrically located; the inductive signature of many vehicles is laterally asymmetrical to an inductive sensor situated at an angle as with the present invention. These asymmetries are exploited by the present invention to yield more unique information about a vehicle than would otherwise be the case.

In one embodiment of the present invention, surface-mount blades sensors are temporarily deployed on the surface of a roadway to detect vehicles as part of a traffic-flow study. For example, a typical two-lane roadway having a width of twelve feet per-lane is to be instrumented with three surface-mount blade sensors per lane. The blade sensors are pre-fabricated at one location and then transported to the roadway site for installation. A bituthane tape six-inches wide and thirty-feet long has a non-adhesive side and an adhesive side to which sensor wires have been attached in a carefully measured pattern. The sensor wires have a wax-paper protective sheet attached, is positioned onto the roadway such that it spans the entire width of the roadway at an angle of approximately 20° to a line perpendicular to the direction of vehicle travel. The tape contains one surface-mount blade per lane, or one surface-mount blade that is shared by all lanes. If it contains one blade per lane, then it is important to position the boundary between the sensors and as near to the marked boundary between the lanes if any. Ideally the tape is properly positioned and tensioned to achieve a substantially straight-line track across the roadway, and then the protective sheet, if any, is pulled away to allow the tape to freely adhere to the roadway surface. The tape adheres better if the roadway surface is cleaned first, typically using a leaf blower to remove loose dirt and sand. This protective layer is peeled away using the tabs 1902, 1904 that have been pre-positioned for this purpose.

Figure 9:
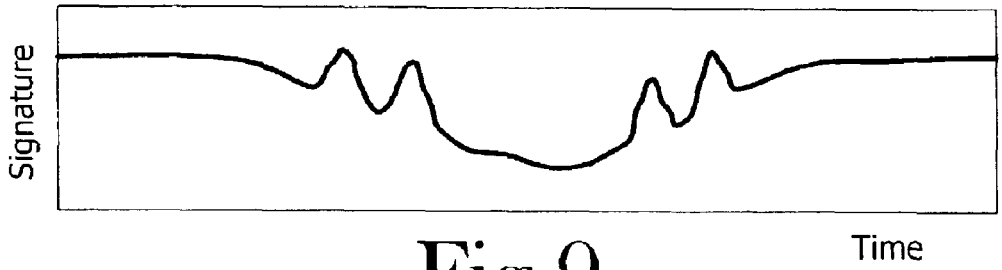
FIG. 9 illustrates the inductive signature of a typical passenger car (Honda Accord) traveling in a first direction as recorded by a surface-mount blade sensor similar to the one depicted in FIG. 8 and having a length dimension of approximately 10 cm.
Figure 10:
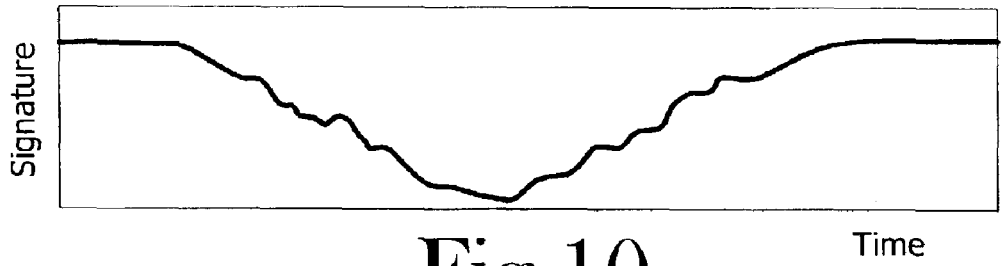
FIG. 10 illustrates the inductive signature of a typical passenger car (Toyota Corolla) traveling in a first direction as recorded by a surface-mount blade sensor similar to the one depicted in FIG. 8.
Figure 11:
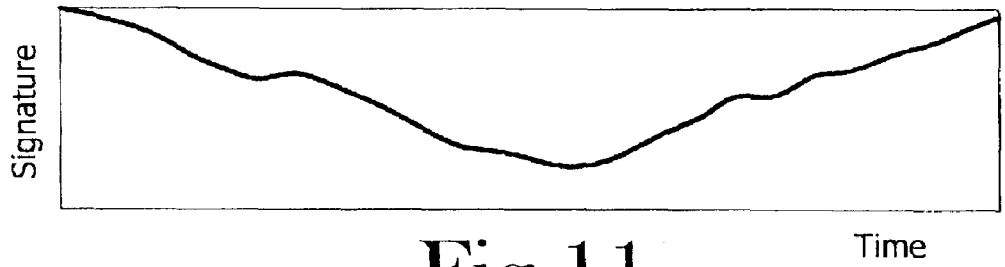
FIG. 11 illustrates the inductive signature of a typical passenger car (Porche 911) traveling in a first direction as recorded by a surface-mount blade sensor similar to the one depicted in FIG. 8.
Figure 12:
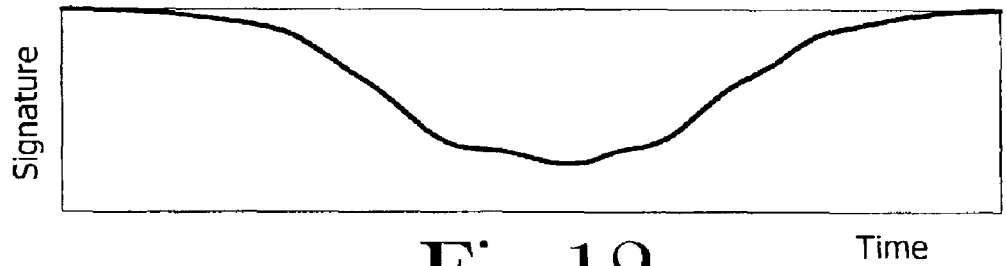
FIG. 12 illustrates the inductive signature of a typical pickup truck (Ford F-150) traveling in a first direction as recorded by a surface-mount blade sensor similar to the one depicted in FIG. 8.
Figure 13:
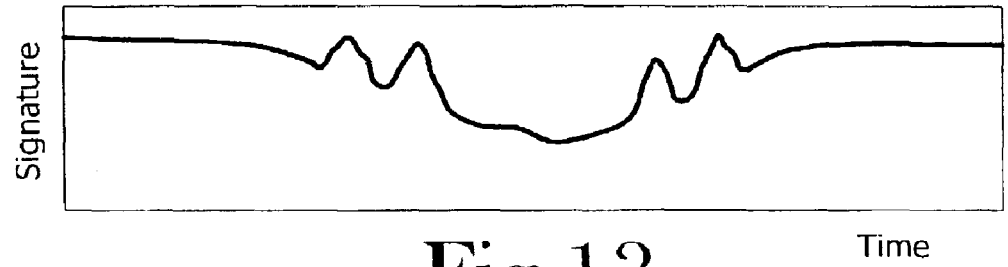
FIG. 13 illustrates the inductive signature of the same passenger car referenced in FIG. 10 traveling in the opposite direction as recorded by a surface-mount blade sensor similar to the one depicted in FIG. 8.
Figure 14:
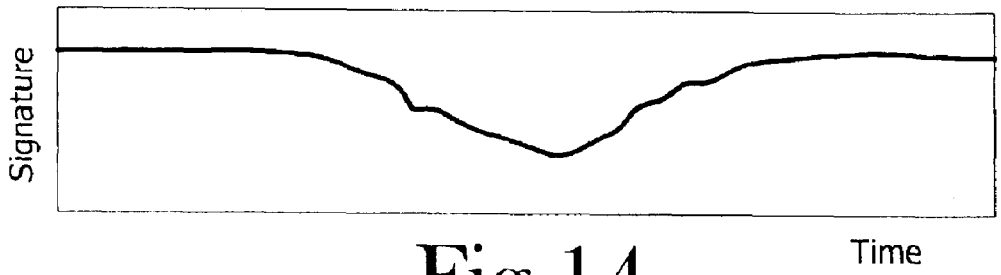
FIG. 14 illustrates the inductive signature of the same passenger car referenced in FIG. 10 (and traveling in the same direction) as recorded by a surface-mount blade sensor similar to the one depicted in FIG. 8 and having a length dimension of approximately 10 cm.
Figure 15:
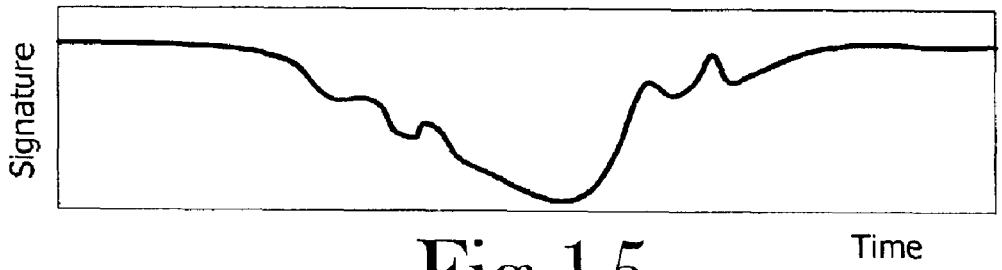
FIG. 15 illustrates the inductive signature of the same passenger car referenced in FIG. 10 (and traveling in the same direction) as recorded by a surface-mount blade sensor similar to the one depicted in FIG. 8 and having a length dimension of approximately 15 cm.
Figure 16:
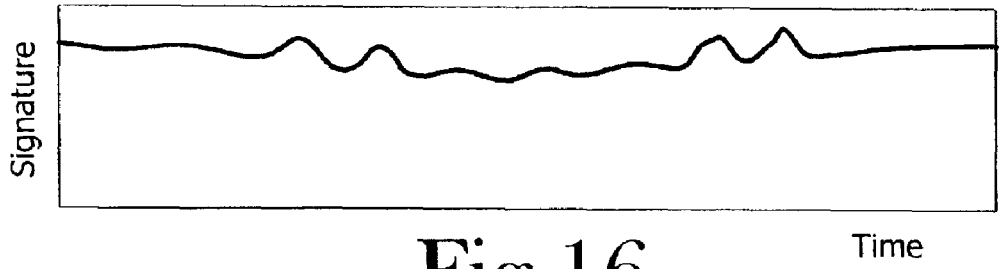
FIG. 16 illustrates the inductive signature of the same passenger car referenced in FIG. 10 (and traveling in the same direction) as recorded by a surface-mount blade sensor similar to the one depicted in FIG. 8 and having a length dimension of approximately 25 cm.

Wheel-spike amplitudes tend to shrink as the sensor length, noted as L in FIG. 6 is increased and they tend to become indistinguishable within the rest of the inductive signature when the length is increased much beyond 20 centimeters. FIG. 9, FIG. 10, FIG. 11, and FIG. 12 illustrate the concept that wheel-spike amplitudes become less distinguishable as the sensor length is increased. FIG. 9 depicts an inductive signature of a passing vehicle as recorded by a surface-mount blade sensor having a length of approximately 10 centimeters. The inductive signature resulting from the 10 centimeter surface-mount blade sensor reading illustrates distinct wheel-spike amplitudes. FIG. 10 depicts an inductive signature of the same passing vehicle discussed in FIG. 8 as recorded by a surface-mount blade sensor having a length of approximately 15 centimeters. It is illustrated in the inductive signature of FIG. 10 that the wheel-spike amplitude is significantly less distinctive than the wheel-spike amplitude of FIG. 9. Further, FIG. 11 depicts an inductive signature of the same passing vehicle discussed in FIG. 8 as recorded by a surface-mount blade sensor having a length of approximately 25 centimeter. The inductive signature illustrated in FIG. 11 reveals that a further loss of definition of wheel-spike amplitude results from a further increase in the surface-mount blade sensor. Finally, FIG. 12 depicts an inductive signature of the same passing vehicle discussed in FIG. 8 as recorded by a surface-mount blade sensor having a length of approximately 180 centimeters. The inductive signature of FIG. 12 reveals essentially no distinct wheel-spike amplitude. It is therefore evident from the inductive signatures of FIG. 9, FIG. 10, FIG. 11, and FIG. 12 that as the length of a surface-mount blade sensor increases, the distinct revelation of a wheel-spike amplitude decreases. Therefore, to detect wheel spikes, it is desirable to use a sensor length of less than 20 centimeters. Also, blade sensors may be placed in a traffic lane at parallel angles, one blade sensor downstream from the other, to detect speed; a third may be placed at an opposite angle to detect asymmetries in the vehicle's inductive signatures. The inductive signatures of surface-mount blade sensors are also used to identify particular vehicles. Inspecting the inductive signatures of FIG. 13, FIG. 14, FIG. 15, and FIG. 16, an individual is able to distinguish between the signatures. The signature of FIG. 13, FIG. 14, FIG. 15, and FIG. 16 are the result of a Honda Accord, a Toyota Corolla, a Porche 911, and a Ford F-150 respectively. Therefore, understanding the inductive signatures of various vehicles allows an individual to identify the vehicles activating the present invention.

Figure 17:
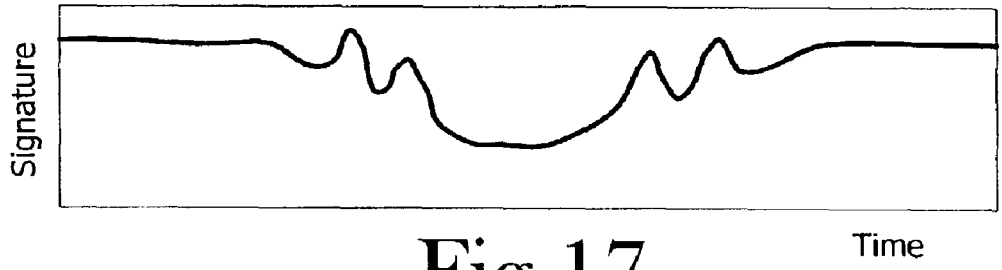
FIG. 17 illustrates the inductive signature of the same passenger car referenced in FIG. 10 (and traveling in the same direction) as recorded by a surface-mount blade sensor similar to the one depicted in FIG. 8 and having a length dimension of approximately 180 cm.
Figure 18:
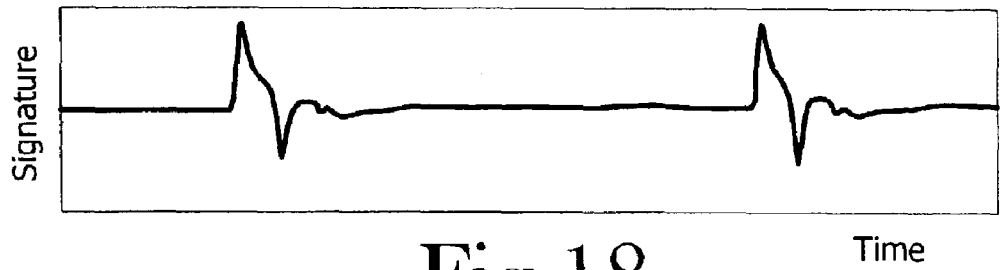
FIG. 18 illustrates a typical wheel-spike detection pattern from the road-tube wedge of the present invention.

FIG. 17 illustrates an inductive signature for the vehicle discussed with FIG. 8, however, the vehicle pertaining to FIG. 17 is traveling in the opposite direction of the vehicle in FIG. 8.

Figure 22:
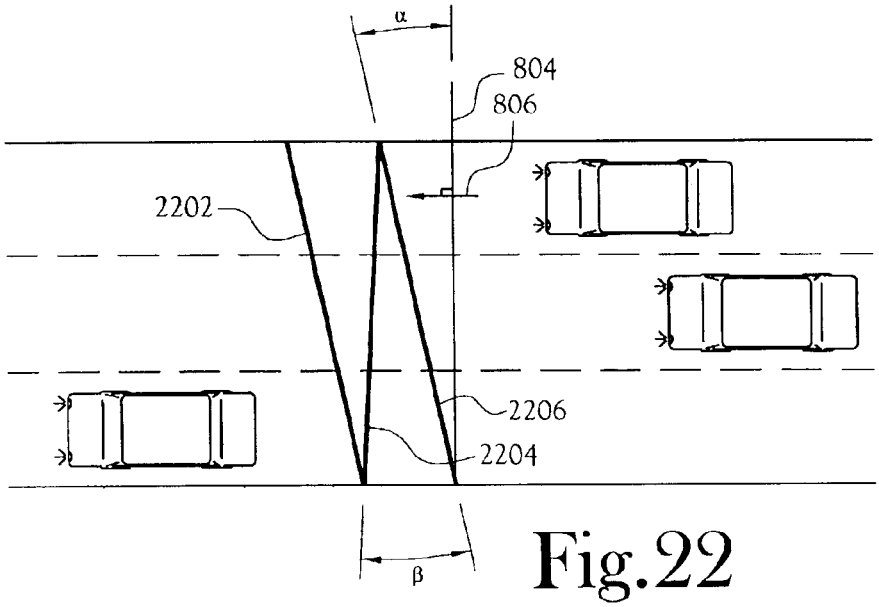
FIG. 22 depicts a road-tube wedge installation of the present invention.

In an alternate embodiment of the present invention, three linear road tubes 2202, 2204, 2206 are placed across one or more lanes of traffic, as shown in FIG. 22, and are actuated by the wheels of over-passing vehicles. The displacement or pressurization of a fluid (whether gas or liquid, though a liquid is preferred if maximum power is to be generated) within the tube in reaction to any wheel of a vehicle rolling over the tube (e.g., a wheel-spike event) is used to generate electricity to power the traffic flow detector of the present invention, associated communications or data processing equipment, traffic control signals, call boxes, or any of a wide variety of similar devices which benefit from small amounts of locally generated electric power. Either the displacement of the fluid or the increase in pressure within the tube may be sensed by using any of a wide variety of switches or transducers to effect a measurement of wheel-spike events. Piezoelectric pressure transducers are especially useful in that they do not draw any electrical power when vehicles are not being detected, they produce a voltage output when vehicles are detected which may be used to "wake up" a quiescent detection device, and they are ganged to generate power suitable for operating the detector. The measurement of a wheel spike event includes timing as well as magnitude and profile (e.g., signature) parameters. The timing of the wheel-spike events is useful to deduce, given knowledge of the geometric configuration (geometry) of the tubes with respect to the surface of the roadway, both fixed and variable parameters of over-passing vehicles including presence, occupancy, speed, acceleration, lane position, wheelbase dimensions, and angle-of-attack. Using a hydraulic (e.g., substantially incompressible) fluid within the tube, such as water, the magnitude and profile of the wheel-spike events can be used to deduce the weight and load distribution of the vehicle which is in turn useful for classification, re-identification, vehicle occupancy sensing, traffic-flow screening for overweight vehicles, unbalanced vehicles (e.g., rollover risk assessment, ship/aircraft cargo weight and balance, car-bomb threat potential), etc.

Once the road tubes or surface-mount blades of the present invention are deployed, and the wheel-spike events and/or inductive signatures are recorded, the data collected is conveyed in real time to a processing device for immediate use or stored in a solid-state or other suitable memory media, such as a hard drive, for later retrieval. When processed, the data recorded by the traffic-flow detector of the present invention yields detailed information about the vehicles that have over-passed the detector. When multiple detection stations record traffic data contemporaneously, this data is reconciled to produce link-data (also called "section data") such as travel-time, origin and destination data ("O/D data"), lane-keeping variation, and other important measures of driver behavior. To assist in reconciling the data from multiple detector station of the present invention, it is desirable to time-stamp the wheel-spike events and/or signatures recorded. One way to accomplish this is to provide a time-code receiver with the detector. Several countries broadcast time-code standards based on atomic clocks which are received by anyone, and used for purposes such as contemplated here. In one embodiment, GPS signals or synchronized clocks are used for suitably accurate time-stamping.

The road tubes and surface-mount blades of the present invention are typically placed at a plurality of skew angles relative to the direction of traffic flow. This causes each wheel of the vehicle to produce a wheel-spike in the sensor output stream that is distinguishable from every other wheel. Occasionally, in multi-lane traffic, a plurality of wheels may come into contact with the sensor tube at the same time and the wheel-spikes will merge into a composite wheel-spike. The probability of this occurring at any given time is relatively small, and can usually be compensated for even in the most dense traffic flows on the widest freeways. For example, on a seven-lane freeway (each direction) which has a peak volume of ~10,000 vehicles per hour passing a fixed-point detector station, there will be an average of around 50,000 wheel-spike events per hour detected by each road tube. The average duration of each event is approximately 6.5 milliseconds, and the duty-cycle of the detectors averages around 9%. For any given wheel-spike, the probability of a second wheel-spike occurring simultaneously is around 10%; the probability of three wheel spikes occurring simultaneously is around 0.9%; the probability of four wheel spikes occurring simultaneously is around 0.07%, etc.

When these chance events occur, there is typically enough redundancy in the data stream from the detector to detect and correct the coincidence even when the coincidence cannot be corrected, the occurrence is infrequent enough to render the problem manageable for most uses of the data. When the wheel-spike magnitudes are measured, the simultaneous occurrence of multiple wheel spikes are distinguishable by noting the additive magnitudes of the spikes. The use of multiple road tubes or surface-mount blades with varying skew angles, varying speeds, lane position, wheelbase dimensions, angles-of-attack, weight and load distributions of random vehicles all help to distinguish the wheel-spike data stream from multiple vehicles into unique "tire tracks," and to further distinguish these tire-tracks into individual vehicle tracks. The speed, heading, lane position, wheelbase dimensions, weight and loading for every vehicle crossing over the road-tube or surface-mount blades sensors of the present invention are measured with great accuracy.

Figure 21C:
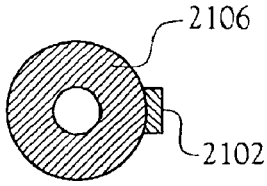
FIGS. 21*a*–21*d* illustrates various configurations or surface-mounted sensors including stiffening rods.
Figure 21D:
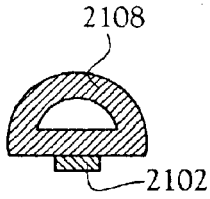
Figure 21A:
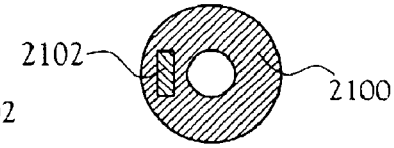
Figure 21B:
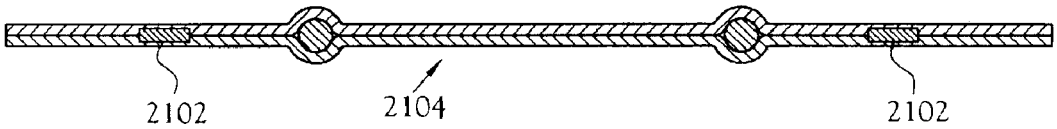

To deploy the road tubes or surface-mount blades of the present invention with maximum safety and convenience for the personnel involved, and for the motorists on the highway, it is sometimes desirable to stiffen the road tubes or blade tapes so that they can be pushed across the roadway in a more or less straight line. This is accomplished by embedding a thin stiffening strip 2102 of hardened steel, or any other material having similar stiffening properties, within the road tube 2100 as shown in FIG. 21*a*, or surface-mount inductive sensor 2104 as shown in FIG. 21*b*, or by cementing the strip 2102 on the outside of the tube as shown in FIG. 21*c*, or tape. Half-round style road tubes 2108 are available with flat bottoms that afford a convenient surface where the stiffening strip may be attached, as shown in FIG. 21*d*. The addition of a stiffening strip to the road tube or tape provides greater linear shaping to the strip in the absence of tensile forces, and allows for greater tensile forces to be applied to straighten and anchor the road tube or tape without stretching the rubber.

Alternate embodiments of the present invention include using pneumatic tubes, piezoelectric strips, fiber optic treadles, inductive loops, laser beams, or any other detection method which detects the track of vehicle wheels along a roadway. The present invention is intended for use with both permanent and temporary installations. It is further anticipated that more than three linear sensing elements may be deployed together to yield slightly enhanced traffic flow information, and that less than three linear elements may be deployed together to yield less traffic flow information. The amount of traffic flow information desired is dependent on the particular requirements of the traffic study. It is further anticipated that a group of one or more linear traffic flow sensors may be deployed with a wide variety of power sources, communications options, and varying durations of deployment without departing from the spirit of scope of the present invention.

In one embodiment, inductive sensors are installed below the surface of pre-existing pavement without cutting into the pavement if there are pre-existing expansion joints, as is common with concrete pavement as opposed to asphalt pavement. Typically concrete pavements are laid down as a plurality of squares with expansion joints between them; these expansion joints are sometimes then filled with a flexible sealant. To install an inductive sensor or lead wire without cutting into the pavement, a portion of the sealant material in the expansion joints, if any, along with any foreign objects are removed and the inductive sensor or lead wire is then laid in the expansion joint, and the joint is then resealed if desired. The walls of the expansion-joint are ground, or otherwise prepared, so that they can more easily accept the sensors to be installed. This operation is accomplished with relative ease from above the pavement surface in cases where the paved area can be closed and the sensor installation accomplished without disruption to traffic flow (e.g., on airport runways and taxiways or parking lots that are typically not heavily traveled in early morning hours).

In cases where it is not convenient to close the paved area in order too accomplish the installation of the sensors (e.g., on a major freeway), the installation operation is accomplished entirely from one or both sides of road without any significant disruption to traffic flow by tunneling into the expansion joints from the side of the road. In the preferred embodiment of the present invention this tunneling operation comprises drilling into the expansion-joint from the side using a masonry bit and a long flexible shaft. It is useful that the drill and shaft be designed so such that the drill bit preferentially seeks the bottom edge of the expansion joint so that the drill will not exit the expansion-joint slot from the top and protrude above the surface of the pavement where it could interfere with traffic. Once this drill has tunneled all the way across the roadway, typically from one shoulder to the other, a cable-saw, loop wire, sealant-dispensing tube, pre-fabricated blade sensor, magnetometer sensor, or any other device desirable such as sensors or tools to aid in the installation of sensors are pulled into the slot.

This same installation method is accomplished by tunneling into asphalt or concrete even when there is no expansion joint, but a greater effort is required to tunnel through the harder materials. In one embodiment, vertically oriented inductive blade sensors are installed within pre-existing expansion-joints. Alternately, horizontally oriented wire-loop inductive sensors are deployed using a plurality of expansion joints, or magnetometer sensors are deployed using a pre-existing expansion joint. Though the present invention has been illustrated using these specific types of sensors, it is intended that other types of sensors (e.g., temperature sensor, salinity sensor, weigh-in-motion sensor, etc.) and local electric power generators deployed within an expansion-joint fall within the scope of the present invention.

Other methods of deploying sensors into a pre-existing expansion joint from the side of the road without substantial disruption to traffic flow also fall within the scope of the present invention. Where new pavement construction is planned, the geometry of the expansion joints can be designed-to maximize their utility as sensor receptacles according to the present invention. In one embodiment, the design and fabrication of the expansion-joint cross section is made smooth, and of uniform dimension; and reverse-tapered features are molded into the walls of the expansion-joint to facilitate the retention of sensing elements within the channel. In another embodiment, the angle at which the expansion-joint crosses the roadway, with respect to a line perpendicular to the traffic flow, is chosen to maximize the wheel-spike information available from sensors housed within the expansion joint; and this angle is held consistent for a plurality of expansion joints along the length of a roadway to maintain the repeatability of vehicle signatures recorded from sensors deployed within the slots. The depth of the expansion joints is held consistent across the width of the roadway to facilitate the accurate measurement of wheel-spike amplitudes and other vehicle signature features regardless of the lateral position of the vehicle on the roadway. Any sensor, lead-line, or related element that is installed within an expansion-joint of the present invention is installed in such a way as to facilitate the subsequent removal, servicing, and re-installation without substantial disruption traffic flow.

In another embodiment, inductive sensors are used to signal over-passing vehicles. For example, in the case of an airport runway incursion mitigation system where inductive sensors are situated on taxiways and/or runways to detect vehicles, or electric field sensors to detect pedestrians/animals, it is useful to communicate traffic-signal information to vehicles in the immediate vicinity of the sensors. For example, if an aircraft is on a taxiway and approaching an active runway, and an inductive sensor is placed on the taxiway to sense vehicles entering the runway, the inductive sensor may also be used to provide traffic-signal information to the aircraft (e.g., "runway is occupied", "runway is clear", "runway is closed", etc.). Likewise, in a highway work-zone a temporary (or permanent) vehicle sensor may be placed on the roadway upstream of the work-zone to warn workers of dangerous traffic conditions. These same sensors are also used to communicate traffic signal information to motorists (e.g., "work-zone ahead", "too fast for curve", etc.). In fact, any of a large variety of pre-defined traffic-signal messages may be communicated in a like manner. There a several methods for communicating this type of traffic-signal information using inductive sensors as an antenna. In one embodiment of the present invention, a pre-defined set of carrier-wave frequencies is established where each pre-defined frequency, or group of frequencies as in Dual Tone Multi Frequency (DTMF) encoding, is used to signal any of a wide variety of traffic conditions. The inductive sensor is driven with a fixed-frequency carrier corresponding to any of a number of pre-defined messages without significantly interfering with the vehicle sensing capability of the sensor. Alternately, the carrier waves are amplitude or frequency modulated to communicate more complicated messages.

Testing has shown that a vehicle is not perfectly symmetric in its physical structure. Meaning that if a vehicle was cut in half down the middle the left side of the vehicle would produce a signature different from the right side of the vehicle. Thus the two halves can be used to aid in uniquely identifying a vehicle. Information about the lateral asymmetry of the vehicle, when used with other methods, increases the precision of vehicle classification and re-identification.

While the present invention has been illustrated by description of several embodiments and while the illustrative embodiments have been described in detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A method for fabricating a surface-mount traffic sensor, said method comprising the steps of:

(a) selecting a first sheet member having sufficient wear resistance to withstand being driven over repeatedly by a plurality of vehicles, said first sheet member having an adhesive surface;

(b) forming a loop from an electrically conductive wire on said adhesive surface of said first sheet member, said loop having an a first excess wire segment of said wire and a second excess wire segment of said wire where said loop closes, said first excess wire segment and said second excess wire segment being twisted to form a lead-line pair, said lead-line pair being running beyond one end of said first sheet member for connection to a sensor controller; and (c) impressing said loop and said lead-line pair into said first sheet member.

2. The method of claim 1 further comprising the step of applying an epoxy to said lead-line pair to hold said first excess wire segment in a fixed position relative to said second excess wire segment in the presence of externally applied forces.

3. The method of claim 1 further comprising the step of applying a protective sheet to said adhesive surface to prevent said adhesive surface from contamination by foreign objects, said protective sheet adapted to be easily disengaged from said adhesive surface.

4. The method of claim 1 further comprising the step of attaching a second sheet member to said first sheet member adhesive surface, said second sheet member having an adhesive surface not in communication with said first sheet member.

* * * * *